US007516567B2

(12) United States Patent
Jiang et al.

(10) Patent No.: US 7,516,567 B2
(45) Date of Patent: Apr. 14, 2009

(54) STEAM IRONING DEVICE HAVING VORTEX GENERATION ELEMENTS FOR OBTAINING VORTICES IN THE STEAM FLOW

(75) Inventors: Yong Jiang, Singapore (SG); Mohankumar Valiyambath Krishnan, Singapore (SG); Mun Thoh Ma, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 246 days.

(21) Appl. No.: 10/594,490

(22) PCT Filed: Mar. 21, 2005

(86) PCT No.: PCT/IB2005/050961

§ 371 (c)(1),
(2), (4) Date: Sep. 27, 2006

(87) PCT Pub. No.: WO2005/093150

PCT Pub. Date: Oct. 6, 2005

(65) Prior Publication Data

US 2007/0193076 A1 Aug. 23, 2007

(30) Foreign Application Priority Data

Mar. 29, 2004 (EP) ..... 04101288

(51) Int. Cl.
*D06F 75/18* (2006.01)
*D06F 75/38* (2006.01)

(52) U.S. Cl. ..... 38/77.83; 38/93

(58) Field of Classification Search ..... 38/93, 38/77.83, 77.6, 77.1, 77.81, 80, 81, 82, 88, 38/97

See application file for complete search history.

(56) References Cited

U.S. PATENT DOCUMENTS 2,700,236 A * 1/1955 Marvin et al. ..... 38/77.83
2,750,690 A * 6/1956 Gomersall ..... 38/77.9
3,110,975 A * 11/1963 Kircher ..... 38/77.7
3,335,507 A * 8/1967 Vieceli ..... 38/77.9

(Continued)

FOREIGN PATENT DOCUMENTS

CN 1 526 367 9/2004

(Continued)

OTHER PUBLICATIONS

Database WPI, Section CH, Week 199107, AN 1991-050334.

(Continued)

*Primary Examiner*—Ismael Izaguirre

(57) ABSTRACT

A steam iron (1) comprises a steam conditioning device (30) having two vortex chambers (31, 32). Inside the vortex chambers (31, 32), directing means such as a conduit for directing a steam flow toward outlets (33) of the steam conditioning device (30) are arranged. Further, inside the vortex chambers (31, 32), vortex generating means are arranged, which are arranged along a path followed by the steam flow, and which are adapted to creating local pressure differences in the steam flow in order to obtain local vortices in the steam flow. By means of the vortices, during operation of the steam conditioning device (30), water drops which are present in the steam flow are broken down to a smaller particle size. In this way, the steam conditioning device (30) is capable of producing mist-steam or dry steam.

12 Claims, 3 Drawing Sheets

U.S. PATENT DOCUMENTS

Figure 1:
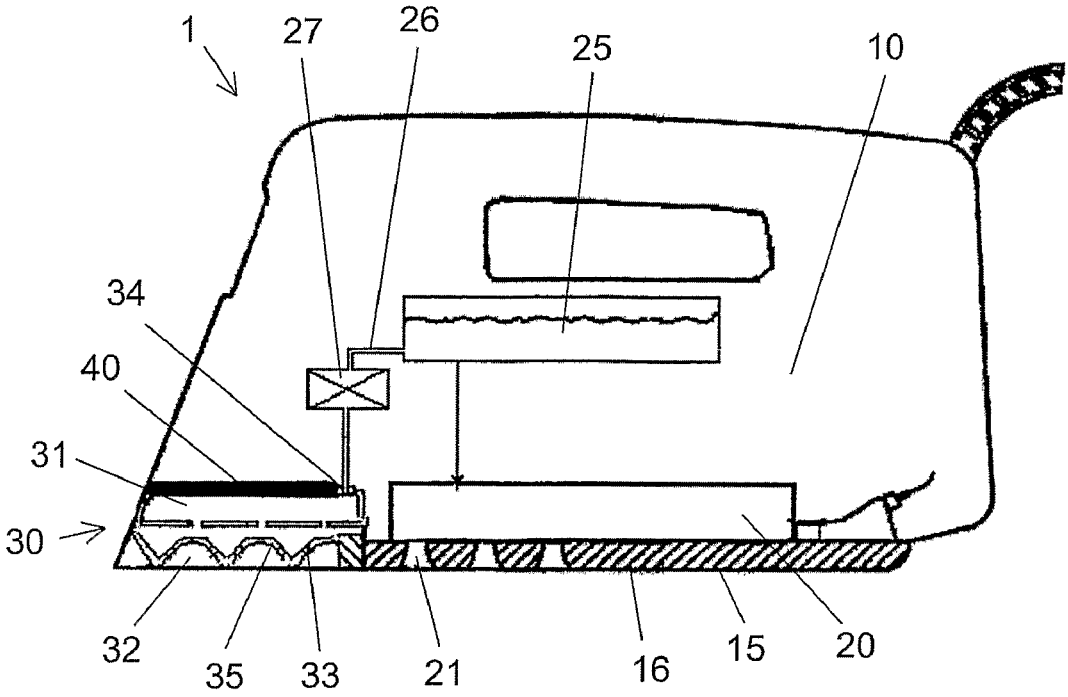

| | | | | |
|---|---|---|---|---|
| 4,594,800 | A | 6/1986 | Herrman et al. | |
| 5,279,054 | A * | 1/1994 | Chasen | 38/77.7 |
| 5,979,089 | A * | 11/1999 | Bouleau et al. | 38/77.83 |
| 6,009,645 | A * | 1/2000 | Shimizu et al. | 38/77.5 |
| 6,035,563 | A * | 3/2000 | Hoefer et al. | 38/77.1 |
| 6,953,912 | B2 * | 10/2005 | Alday Lesaga | 219/251 |

FOREIGN PATENT DOCUMENTS

| | | |
|---|---|---|
| DE | 20 46 600 | 6/1990 |
| SU | 1 574 249 | 6/1990 |

OTHER PUBLICATIONS

Database WPI, Section PQ, Week 200482, AN 2004-822269.

* cited by examiner

STEAM IRONING DEVICE HAVING VORTEX GENERATION ELEMENTS FOR OBTAINING VORTICES IN THE STEAM FLOW

The present invention relates to a steam conditioning device for use in a steam appliance, in particular a steam iron, the steam conditioning device comprising at least one steam outlet and directing means for directing a steam flow toward the at least one steam outlet along a steam flow path.

In general, a steam iron is used to iron cloth objects, for example garments or curtains, in order to remove wrinkles from the objects. An ironing process in which a steam iron is applied involves supplying steam to these objects in order to moisturize these objects, as it appears that the process of removing wrinkles from the objects is facilitated when the objects are in a moisturized condition.

In many cases, steam irons are not only capable of supplying steam to objects to be ironed, but also of spraying the objects with water, if so desired. For this purpose, the steam irons are provided with a spray nozzle, which is located at a front side of the steam iron, and a manually/electrically operated water pump. When the water pump is activated, water drops are released by the spray nozzle, whereby a region in front of the steam iron is moisturized.

A problem associated with the steam irons comprising a water pump and a spray nozzle is that it is difficult for a user to predict the exact region where the water drops will fall on the object to be ironed. Therefore, it often happens that other regions of the object, which do not need to be moisturized, are moisturized as well, contrary to the intention of the user. Moreover, the size of the released water drops is often so large that the drops are not capable of penetrating into the fibres of the object. As a result, the object is often sprayed with an excessively large quantity of water in order to obtain sufficient moistening of the object.

Another option which is incorporated in many steam irons involves firing a shot of steam toward the object to be ironed, in order to moisturize this object in a way which is comparable to moisturizing the objects by means of water droplets. When the steam iron is activated to fire a shot of steam, a certain amount of water is pumped into a heated steam chamber, where most water is quickly vaporized into steam, whereupon the steam is forced to flow out of the steam chamber at a relatively high speed. Usually, besides the steam, a small amount of residual water is also brought out when the shot of steam is actually fired. In many cases, the drops of residual water are relatively large, as a result of which the release of residual water is considered dripping of the steam iron. Another disadvantage is that the manoeuvrability of the steam iron is limited, as the steam iron needs to be kept still every time a shot of steam is fired.

The present invention proposes a steam conditioning device for use in a steam iron, which device is capable of putting steam in a pre-determined condition and supplying the conditioned steam, for example a so-called mist-steam, i.e. a uniform mixture of steam and fine water droplets. When the objects to be ironed are subjected to a treatment with mist-steam, these objects are moisturized in a very convenient way. Moreover, the above-mentioned disadvantages associated with spraying water onto the objects and firing shots of steam do not occur when mist-steam is applied.

In particular, the steam conditioning device according to the present invention comprises:

at least one steam outlet;

directing means for directing a steam flow toward the at least one steam outlet along a steam flow path; and vortex generating means which are arranged along the steam flow path, and which are adapted to creating local pressure differences in the steam flow in order to obtain vortices in the steam flow.

During operation, the steam conditioning device according to the present invention may be supplied with water or, for example, a mixture of steam and water drops. Preferably, the steam conditioning device comprises heating means for heating its content in order to put and/or keep this content in a desired condition, in particular in order to obtain and/or maintain a mixture of steam and water drops according to a predetermined mixture ratio.

Furthermore, during operation of the steam conditioning device according to the present invention, the mixture of steam and water is forced to flow to at least one steam outlet. In a practical embodiment, the steam conditioning device is provided with a plurality of steam outlets. For the sake of clarity, the flow which is present inside the steam conditioning device during its operation is referred to as steam flow, regardless of the ratio of the amount of water to the amount of steam. A flow of pure steam, in which no water in a liquefied condition is present, is also referred to as steam flow. It is noted that pure steam is also referred to as dry steam.

For the purpose of directing the steam flow along a steam flow path toward the at least one steam outlet, the steam conditioning device according to the present invention comprises directing means, which, for example, are shaped like a matrix of conduits or a channel. Furthermore, according to an important aspect of the present invention, the steam conditioning device comprises vortex generating elements, which are arranged along the steam flow path. The arrangement and the shape of the vortex generating elements are chosen such that vortices are generated in the steam flow at the positions where the steam flow encounters the vortex generating elements, resulting from the fact that at these positions, pressure differences are created in the steam flow. For example, the vortex generating elements may be shaped like baffles or other steam flow hindering members, or like pockets positioned along the steam flow path.

The generation of vortices contributes to obtaining a uniform mixture of steam and fine water particles. In fact, a local mixing process takes place at the position of every vortex which is generated in the steam flow. Furthermore, water drops which are present in a vortex are broken down to a smaller particle size. In this way, according to the present invention, it is possible to obtain a very fine mist comprising relatively small water particles, i.e. water particles having a size which is within a range from 20 μm to 60 μm. When a cloth object is subjected to such mist, it is moisturized in a convenient manner, wherein the obtained moisturized condition is optimal for the purpose of ironing the object. It is noted that U.S. Pat. No. 4,594,800 discloses a steam iron having a steam conduit system which is shaped such that, during operation of the steam iron, the steam is constrained to follow a vortex flow path, wherein the heavier water drops which are present in the steam are flung outwards by the action of centrifugal forces, while the lighter steam is enabled to escape at the centre of the vortex. In this way, a better elimination of water droplets entrained by the steam is achieved.

The steam iron as disclosed in U.S. Pat. No. 4,594,800 does not comprise vortex generation means in the sense of the present invention, i.e. vortex generation means which are arranged along the steam flow path, and which are adapted to creating local pressure differences in the steam flow in order to obtain vortices in the steam flow. Instead, the steam iron comprises vortex channels for forcing the entire steam flow to perform a vortex movement, wherein no measures are taken for creating local pressure differences in the steam flow.

In the steam iron known from U.S. Pat. No. 4,594,800, as a result of the vortex movement of the steam flow as a whole, the steam and the water are separated. Contrariwise, the present invention aims at mixing the steam and the water as much as possible.

Figure 2:
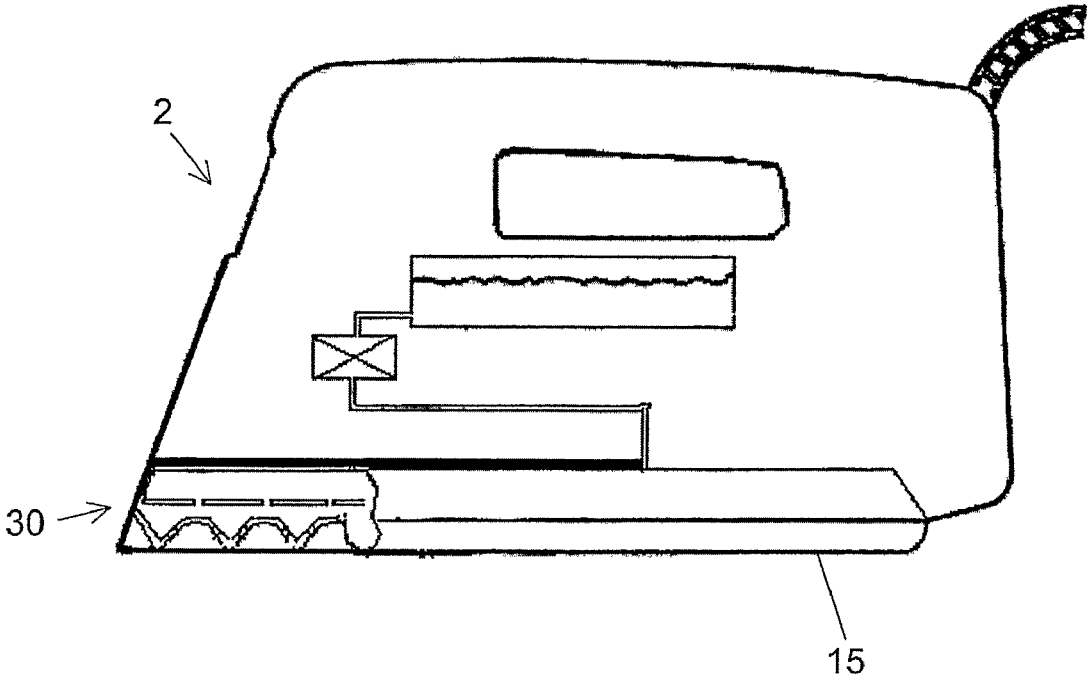
Figure 3:
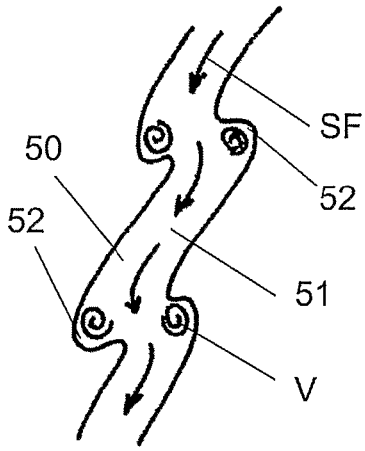
Figure 4:
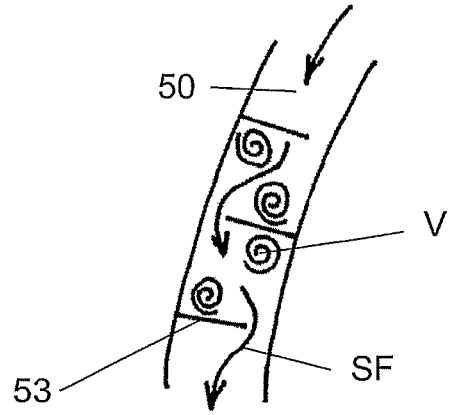
Figure 5:
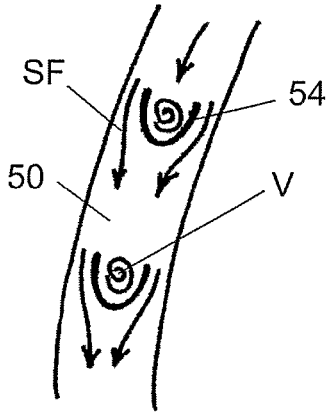
Figure 6:
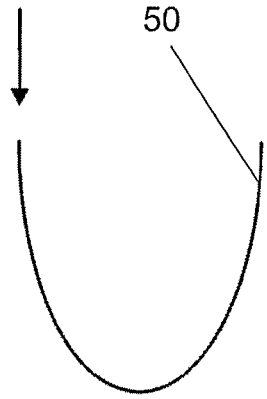
Figure 7:
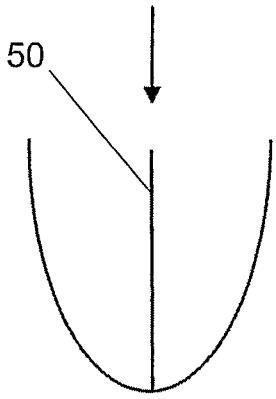
Figure 8:
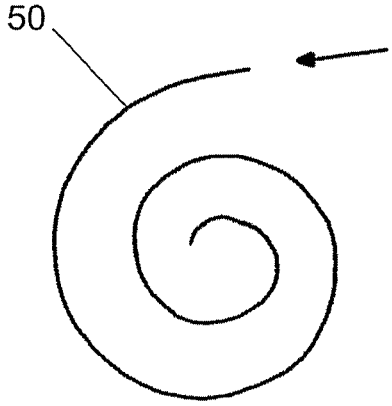
Figure 9:
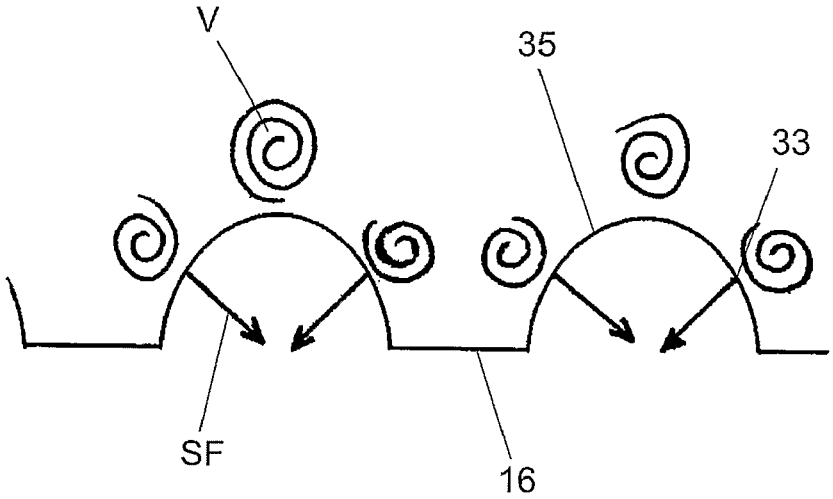
Figure 10:
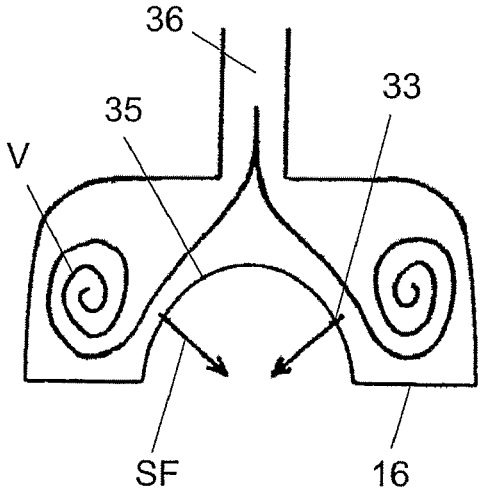
Figure 11:
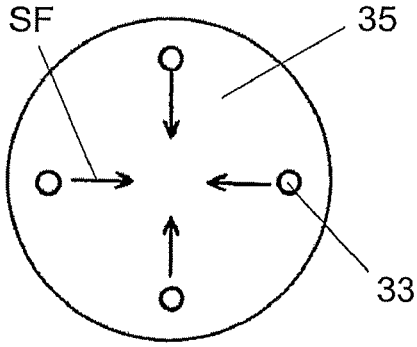
Figure 12:
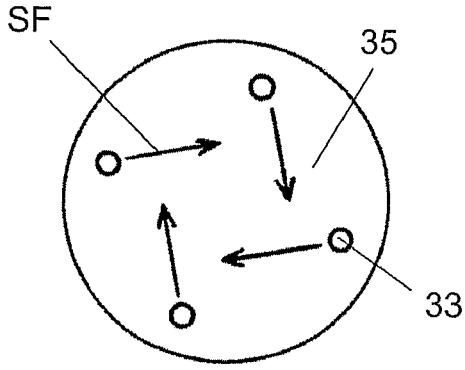

The present invention will now be explained in greater detail with reference to the Figures, in which similar parts are indicated by the same reference signs, and in which:

FIG. 1 diagrammatically shows a steam iron comprising a steam conditioning device according to the present invention;

FIG. 2 diagrammatically shows another steam iron comprising a steam conditioning device according to the present invention;

FIG. 3 diagrammatically shows a longitudinal section of a first preferred embodiment of a flow directing conduit which is part of the steam conditioning device according to the present invention;

FIG. 4 diagrammatically shows a longitudinal section of a second preferred embodiment of a flow directing conduit which is part of the steam conditioning device according to the present invention;

FIG. 5 diagrammatically shows a longitudinal section of a third preferred embodiment of a flow directing conduit which is part of the steam conditioning device according to the present invention;

FIG. 6 diagrammatically shows a first preferred overall shape of a portion of the flow directing conduit which is part of the steam conditioning device according to the present invention;

FIG. 7 diagrammatically shows a second preferred overall shape of a portion of the flow directing conduit which is part of the steam conditioning device according to the present invention;

FIG. 8 diagrammatically shows a third preferred overall shape of a portion of the flow directing conduit which is part of the steam conditioning device according to the present invention;

FIG. 9 diagrammatically shows a longitudinal section of a portion of the steam conditioning device according to the present invention near the steam outlets of said steam conditioning device;

FIG. 10 diagrammatically shows a cross section of the portion of the steam conditioning device shown in FIG. 9;

FIG. 11 diagrammatically shows a top view of an area surrounding a steam outlet of the steam conditioning device according to the present invention and flow directions of released steam; and FIG. 12 also diagrammatically shows a top view of an area surrounding a steam outlet of the steam conditioning device according to the present invention and flow directions of released steam.

FIG. 1 diagrammatically shows a steam iron 1, which comprises a housing 10 for accommodating the various components of the steam iron 1. A few of the components of the steam iron 1 are diagrammatically depicted in FIG. 1, and will be discussed in the following.

At a bottom side, the steam iron 1 comprises a soleplate 15 having a soleplate surface 16 for contacting the objects to be ironed.

The steam iron 1 comprises a conventional steam chamber 20 and a water tank 25 for containing water and supplying water to the steam chamber 20 during operation of the steam iron 1. For the purpose of letting out the steam which is generated in the steam chamber 20, steam outlets 21 are arranged in the soleplate 15.

Furthermore, the steam iron 1 comprises a steam conditioning device 30 according to the present invention. In the shown configuration, the steam conditioning device forms part of the soleplate 15, while it is positioned at a front side of the steam iron 1.

The steam conditioning device 30 is connected to the water tank 25 through a channel 26 and a water pump 27, which is preferably electric. During operation of the steam conditioning device 30, the water pump 27 is activated, and the steam conditioning device 30 is supplied with water. For the purpose of converting the water to steam, the steam conditioning device 30 comprises heating means 40, which are preferably electrically powered. Preferably, the heating means 40 comprise flat resistive heating tracks. Furthermore, the steam conditioning device 30 comprises steam outlets 33 for releasing the generated steam.

The heating means 40 for heating a content of the steam conditioning device 30 play an important role in preventing the steam conditioning device 30 from dripping. Without these heating means 40, it is very likely that prolonged application of the iron 1 comprising the steam conditioning device 30 leads to loss of heat in the steam conditioning device 30. Such a loss of heat will likely lead to condensation of the content of the steam conditioning device 30, and condensation leads to dripping. In case the heating means 40 are applied, it is possible to keep the temperature inside the steam conditioning device 30 at a sufficiently high level.

According to an important aspect of the present invention, the steam conditioning device 30 is equipped for creating vortices in a steam flow which is present during operation, and which is directed toward the steam outlets 33.

In the shown embodiment, the steam conditioning device 30 according to the present invention comprises two vortex chambers 31, 32. In both vortex chambers 31, 32, structural arrangements are present, which play a role in generating vortices in the steam flow. According to the present invention, the structural arrangements are shaped such that these arrangements are capable of creating local pressure differences in the steam flow, on the basis of which the desired vortices are obtained.

In a first vortex chamber 31, i.e. the vortex chamber 31 having an inlet 34 for letting in water from the water tank 25, structural arrangements aimed at creating vortices substantially in a horizontal plane, i.e. a plane substantially parallel to the soleplate surface 16, are provided. Examples of the structural arrangements are shown in FIGS. 3-5.

According to the first example as shown in FIG. 3, the steam flow is directed through a conduit 50 having conduit portions 51 which do not establish continuations of each other, but which are interconnected in a staggering manner, instead. In this way, both ends 52 of each conduit portion 51 function as dead ends or as a kind of pockets, at the position of which vortices are generated when the steam flow passes by. According to the second example as shown in FIG. 4, the steam flow is directed through a conduit 50 in which baffles 53 are arranged. The baffles 53 extend from a wall of the conduit 50 into the steam flow path. In the shown example, the baffles 53 are arranged in an alternating manner, such that the steam flow has to perform a slalom movement around the baffles 53, as it were. On both sides of each baffle 53, vortices are generated when the steam flow passes by. According to a third example as shown in FIG. 5, the steam flow is directed through a conduit 50 in which U-shaped channel segments 54 are arranged. The U-shaped channel segments 54 are arranged such as to extend in a centre of the steam flow and to open against the direction of the steam flow. Inside each U-shaped channel segment 54, a vortex is generated when the steam flow passes by. In FIGS. 3-5, for the sake of clarity, the steam flow is diagrammatically depicted by means of arrows SF, whereas the vortices are diagrammatically depicted by means of spirals V.

The conduit 50 and the ends 52 of the conduit portions 51, the baffles 53 or the U-shaped channel segments 54 are positioned and shaped such that the vortices V are created in a substantially horizontal plane. To this end, a central axis of the conduit 50 extends in a substantially horizontal plane, and, in the case of baffles 53 or channel segments 54 being arranged inside the conduit 50, the baffles 53 or the channel segments 54 extend in a substantially vertical direction.

It will be understood that the conduit 50 for directing the steam flow SF through the first vortex chamber 31 may have different overall shapes. Three examples of such shapes are shown in FIGS. 6-8. According to the first example as shown in FIG. 6, the conduit 50 is arranged inside the first vortex chamber 31 as a single loop. According to the second example, the conduit 50 is arranged inside the first vortex chamber 31 as a double loop. Finally, according to the third example, the conduit 50 is arranged inside the first vortex chamber 31 as a spiral loop.

In a second vortex chamber 32, structural arrangements aimed at creating vortices V substantially in a vertical plane, i.e. a plane substantially perpendicular to the soleplate surface 16, are provided. FIGS. 9 and 10 show that the second vortex chamber 32 is provided with portions 35 which are raised with respect to the soleplate surface 16. Each raised portion 35 has oblique walls and comprises four steam outlets 33. The first vortex chamber 31 and the second vortex chamber 32 are interconnected by means of channels 36, wherein each channel 36 is positioned right above a raised portion 35. In this way, it is achieved that steam which is provided to the second vortex chamber 32, through a channel 36, collides with the top of the raised portion 35 as soon as it has entered the second vortex chamber 32, flows along the oblique walls of the raised portion 35, and subsequently forms vortices V at various sides of the raised portion 35, in a substantially vertical plane.

The mutual positions of the steam outlets 33 in the raised portions 35 determine the characteristics of the steam flow SF right outside of the second vortex chamber 32. FIGS. 11 and 12 diagrammatically show examples of the mutual positions of the four steam outlets 33 of one raised portion 35, in relation to the directions in which the steam flows SF exit the second vortex chamber 32 through the steam outlets 33. In the Figures, these directions are diagrammatically indicated by arrows SF.

In the example as shown in FIG. 11, the steam outlets 33 are positioned such that all released steam flows SF are directed toward a virtual centre of the steam outlets 33, in order to obtain a collision of the steam flows SF. In the example as shown in FIG. 12, the steam outlets 33 are positioned such that sideward collisions of adjacent released steam flows SF take place, as a result of which a vortex is created in the space which is present between the raised portion 35 and the level of the soleplate surface 16.

FIG. 2 diagrammatically shows a steam iron 2, which resembles the steam iron 1 as shown in FIG. 1 to a large extent. A main difference between the steam irons 1, 2 is that in the steam iron 2 as shown in FIG. 2, the steam conditioning device 30 is arranged and shaped such as to form the soleplate 15.

An important advantage of the steam conditioning device 30 according to the present invention is that it is capable of generating mist-steam. Application of this type of steam constitutes a great help during an ironing process, as it has a significant de-wrinkling effect.

When the water is supplied to the first vortex chamber 31, it is heated by the heating means 40. Preferably, the steam iron 1, 2 comprises controlling means (not shown) for accurately controlling the supplied amount of water on the one hand, and the conditions in the first vortex chamber 31 on the other hand. In case it is desired to produce mist-steam, the controlling means control the water supply and the heating means 40 in such a way that a mixture of steam and water drops according to a predetermined mixture ratio is obtained. When the mixture flows through the first vortex chamber 31, vortices V are created under the influence of the structural arrangements which are provided for this purpose along the path followed by the steam flow SF, such as the dead ends 52, the baffles 53 or the U-shaped channel segments 54, which have been disclosed in the foregoing. The creation of the vortices V takes place as a consequence of the difference between a relatively high pressure prevailing in the steam flow path and a relatively low pressure prevailing at the dead ends 52, the baffles 53 or the U-shaped channel segments 54. In the vortices V, the steam and the water drops are mixed, and the water drops are broken down to smaller water droplets. These processes are continued in the second vortex chamber 32. In this way, a uniform mixture of steam and fine water droplets is obtained. When this mixture exits the second vortex chamber 32 through the steam outlets 33, a cloud of mist-steam is obtained.

It will be understood that the number of steam outlets 33 is adapted to the task of creating this cloud of mist-steam, and that this number should therefore not be less than a certain minimum. In case the steam outlets 33 in the raised portions 35 are mutually positioned in the way which is illustrated by FIG. 11, in the space which is present between the raised portion 35 and the level of the soleplate surface 16, the released steam flows SF collide with each other, so that the water droplets break down further. In case the steam outlets 33 in the raised portions 35 are mutually positioned in the way which is illustrated by FIG. 12, in the space which is present between the raised portion 35 and the level of the soleplate surface 16, a vortex is created, so that a further mixing process of the steam and the water droplets takes place.

The controlling means are applied to determine the wetness of the mist-steam, in other words, the water content of the mist-steam, as the wetness is related to the quantity of warmth or heat supplied by the heating means 40 on the one hand, and to the quantity of supplied water on the other hand. Therefore, by controlling the electric power supplied to the heating means 40 and a water flow rate, the wetness of the mist-steam may be put to a desired level. In this way, it is possible to vary the wetness of the mist-steam over time. A desired wetness variation may simply be achieved by only varying the quantity of supplied water over time, or by only varying the electric power supplied to the heating means 40. However, it is also possible that both the quantity of supplied water and the electric power supplied to the heating means 40 are varied over time.

Another important advantage of the steam conditioning device 30 according to the present invention is that it is capable of generating dry steam. Application of this type of steam constitutes a great help during certain ironing processes, especially ironing processes in which relatively high temperatures are allowed. The dry steam may be applied to dry the treated objects.

When the water is supplied to the first vortex chamber 31, it is heated by the heating means 40 in order to generate steam. Given a certain temperature range, it is practically not possible to vaporize all the water. When the mixture of steam and water drops is directed through the vortex chambers 31, 32 and the vortices V are created, the water drops are broken down to smaller water droplets. As the smaller water droplets are easier to vaporize, it is possible to eventually obtain dry steam.

At a position between the water tank 25 and the inlet 34 provided in the first vortex chamber 31 for letting in the water, water pre-treatment means may be arranged, in order to at least partially prevent scale formation in the steam flow path. The exact location of these means is not essential; the water pre-treatment means may be arranged at a position between the water pump 27 and the inlet 34, but may as well be arranged at a position between the water pump 27 and the water tank 25.

Preferably, in a steam iron 1, 2 comprising the steam conditioning device 30 according to the present invention, two separately controllable heating means are arranged, one for heating the content of the steam conditioning device 30, and another for heating the soleplate 15 of the steam iron 1, 2. Only in case of the two heating means being independently controllable, an optimal management of power may be obtained. In a preferred embodiment, individual controlling means are provided, wherein one of the controlling means is associated with the heating means 40 of the steam conditioning device 30, and wherein another of the controlling means is associated with the heating means of the soleplate 15.

The use of having two individually controllable heating means is illustrated by the following example. In a situation in which the temperature of the soleplate 15 is above a predetermined upper limit, the controlling means associated with the heating means of the soleplate 15 are controlled such as to stop the power supply to these heating means. However, at the same time, the supply of mist-steam may be required. In order to avoid a conflict in this situation, which might result in overheating the soleplate 15 or supplying steam of a poor quality, it is important that the heating means 40 of the steam conditioning device 30 and the heating means of the soleplate 15 are independently controlled.

It will be clear to a person skilled in the art that the scope of the present invention is not limited to the examples discussed in the foregoing, but that several amendments and modifications thereof are possible without deviating from the scope of the present invention as defined in the attached claims.

An important aspect of the present invention is that vortex generating means are arranged along the path which is followed by the steam flow SF through the steam conditioning device 30, which vortex generating means are adapted to creating local pressure differences in the steam flow SF in order to obtain vortices V in the steam flow SF. In the above-discussed examples, five structural arrangements, more in particular an arrangement comprising a series of conduit portions 51 which are interconnected in a staggering manner, an arrangement comprising a series of baffles 53 which are arranged such as to interrupt the steam flow SF, an arrangement comprising a series of U-shaped channel segments 54 opening against the direction of the steam flow SF, which are arranged such as to interrupt the steam flow SF, an arrangement comprising oblique walls of raised portions 35, and a certain pattern of steam outlets 33 in said raised portions 35, are shown, which are to be regarded as only five of the many conceivable embodiments of the vortex generating means.

On the basis of the preceding paragraph, it will be clear that a number of the details described in connection with the shown embodiments of the steam conditioning device 30 are not essential. For example, it is not essential that the steam conditioning device 30 comprises two vortex chambers 31, 32. The steam conditioning device is capable of performing its functions when at least one vortex chamber 31, 32 for accommodating vortex generating means is present. Furthermore, the orientation of the planes in which the vortices V are created is not essential; it is not necessary that vortices V are created in both substantially horizontal planes and substantially vertical planes. In case of the vortices V being created in both substantially horizontal planes and substantially vertical planes, it does not matter which orientation is given to the vortices V first, and which orientation is given to the vortices V last.

In case a conduit 50 is applied for directing the steam flow SF inside the steam conditioning device 30, the overall shape of this conduit 50 may be chosen freely.

The at least one vortex chamber 31, 32 of the steam conditioning device 30 may be designed in any suitable way. For example, a matrix of conduits 50 may be accommodated inside the vortex chamber 31, 32. In another embodiment, the vortex chamber 31, 32 contains a channel for directing the steam flow SF toward the steam outlets 33 of the steam conditioning device 30. In case of the steam conditioning device 30 comprising two vortex chambers 31, 32, these two vortex chambers 31, 32 are preferably in communication.

It is not necessary that the steam outlets 33 are arranged at raised portions 35. The steam outlets 33 may even be arranged in a completely planar bottom surface of the steam conditioning device 30. In case the steam outlets 33 are arranged in raised portions 35, the number of steam outlets 33 per raised portion 35 does not necessarily need to be four. The raised portions 35 may be part of the steam conditioning device 30, but may also be part of the soleplate 15.

During operation, the steam conditioning device 30 may be supplied with water, which needs to be heated by the heating means 40 in order to obtain steam. However, it is also possible that the steam conditioning device 30 is connected to, for example, a boiler for supplying a mixture of steam and water drops. In such a case, the conditions inside the steam conditioning device 30 are controlled by the controlling means in such a way that a predetermined mixture ratio is obtained.

It will be understood that, within the scope of the present invention, one conduit 50 may be provided with different types of vortex generating means. For example, a conduit 50 may be shaped like the conduit 50 as shown in FIG. 3, comprising conduit portions 51 which are interconnected in a staggering manner, and also be provided with baffles 53 and/or U-shaped channel segments 54.

The steam conditioning device 30 according to the present invention may be applied in various types of irons and steam ironing devices, for example in a cold water system, a boiler system or an ironing board having a steaming function. Furthermore, the steam conditioning device 30 may for example be applied in a facial steamer.

In the foregoing, a steam iron 1, 2 has been disclosed, which comprises a steam conditioning device 30 having two vortex chambers 31, 32. Inside the vortex chambers 31, 32, directing means such as a conduit 50 for directing a steam flow SF toward outlets 33 of the steam conditioning device 30 are arranged. Further, inside the vortex chambers 31, 32, vortex generating means are arranged, which are arranged along a path followed by the steam flow SF, and which are adapted to creating local pressure differences in the steam flow SF in order to obtain local vortices V in the steam flow SF. By means of the vortices V, during operation of the steam conditioning device 30, water drops which are present in the steam flow SF are broken down to a smaller particle size. In this way, the steam conditioning device 30 is capable of producing mist-steam or dry steam.

According to a first important aspect of the present invention, the steam conditioning device 30 comprises a plurality of steam outlets 33 and a plurality of raised portions 35, wherein the steam outlets 33 are provided in the raised portions 35. The mutual positions of the steam outlets 33 of a raised portion 35 may for example be adapted to directing all released steam flows SF toward a virtual centre of the steam outlets 33, in order to obtain a collision of the steam flows SF, or to obtaining sideward collisions of adjacent released steam flows SF, in order to create a vortex V.

According to a second important aspect of the present invention, the steam conditioning device 30 comprises controlling means for accurately controlling a ratio of an amount of water to an amount of steam of the steam flow SF by controlling the conditions prevailing in the steam conditioning device 30.

According to a third important aspect of the present invention, the steam conditioning device 30 comprises heating means 40 for heating a content of the steam conditioning device 30. Preferably, these heating means 40 comprise flat resistive heating tracks.

According to a fourth important aspect of the present invention, the vortex generating means are adapted to first creating vortices V in one of a substantially horizontal plane and a substantially vertical plane, and subsequently creating vortices V in another of the substantially horizontal plane and the substantially vertical plane.

The invention claimed is:

1. Steam conditioning device (30), comprising:

at least one steam outlet (33);

directing means (50) for directing a steam flow (SF) toward the at least one steam outlet (33) along a steam flow path; and vortex generating means which are arranged along the steam flow path, and which are adapted to creating local pressure differences in the steam flow (SF) in order to obtain vortices (V) in the steam flow (SF); and channel segments (54) for interrupting the steam flow path, which are arranged in order to open against the direction of the steam flow (SF).

2. Steam conditioning device (30) according to claim 1, comprising hindering members (52, 53, 54) for interrupting the steam flow (SF).

3. Steam conditioning device (30) according to claim 1, comprising a conduit (50) for directing the steam flow (SF), which conduit (50) has conduit portions (51) which are interconnected in a staggering manner, wherein the vortex generating means comprise both ends (52) of each conduit portion (51).

4. Steam conditioning device (30) according to claim 1, comprising baffles (53) for interrupting the steam flow path.

5. Steam conditioning device (30) according to claim 1, comprising at least one raised portion (35) having oblique walls, and means (36) for directing the steam flow (SF) toward a top of the raised portion (35).

6. Steam conditioning device (30) according to claim 1, wherein the vortex generating means are adapted to creating vortices (V) in at least two different planes.

7. Steam conditioning device (30) according to claim 1, comprising two vortex chambers (31, 32) for accommodating the vortex generating means, wherein the vortex generating means in a first vortex chamber (31) are adapted to creating vortices (V) in one of two different planes, and wherein the vortex generating means in a second vortex chamber (32) are adapted to creating vortices (V) in another of the two different planes.

8. Steam conditioning device (30) according to claim 1, comprising heating means (40) for heating a content of the steam conditioning device (30).

9. Steam conditioning device (30) according to claim 1, suitable for use in a steam appliance such as a steam iron (1, 2), an ironing board having a steaming function, or a facial steamer.

10. Steam iron (1, 2), comprising a soleplate (15) having a soleplate surface (16) for contacting objects to be ironed, and a steam conditioning device (30) according to claim 1.

11. Steam iron (1, 2) according to claim 10, wherein the steam conditioning device (30) is arranged and shaped such as to form the soleplate (15).

12. Steam iron (1, 2) according to claim 10 , comprising heating means for heating the soleplate (15) and heating means (40) for heating a content of the steam conditioning device (30), wherein the said two heating means are individually controllable.

* * * * *